US005840103A

United States Patent [19]

Dyson

[11] Patent Number: 5,840,103

[45] **Date of Patent: *Nov. 24, 1998**

[54] VACUUM CLEANER AND A FILTER ASSEMBLY THEREFOR

[75] Inventor: James Dyson, Little Somerford, United Kingdom

[73] Assignee: Notetry Limited, Wiltshire, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 836,497

[22] PCT Filed: Nov. 22, 1995

[86] PCT No.: PCT/GB95/02723

§ 371 Date: Jul. 8, 1997

§ 102(e) Date: Jul. 8, 1997

[87] PCT Pub. No.: WO96/15709

PCT Pub. Date: May 30, 1996

[30] Foreign Application Priority Data

Nov. 24, 1994 [GB] United Kingdom ..... 9423756

[51] Int. Cl.[6] ..... B03C 3/36

[52] U.S. Cl. ..... 96/61; 15/347; 55/323; 55/337; 55/471; 55/DIG. 3; 96/63

[58] Field of Search ..... 55/337, 334, 471–473, 55/DIG. 3, DIG. 2, 321, 323; 96/61–63; 95/78; 15/347, 352

[56] References Cited

U.S. PATENT DOCUMENTS

| | | | |
|---|---|---|---|
| 3,871,847 | 3/1975 | Fish | 55/DIG. 3 |
| 5,248,323 | 9/1993 | Stevenson | 55/DIG. 3 |

FOREIGN PATENT DOCUMENTS

| | | |
|---|---|---|
| 8420758 | 12/1985 | Germany . |
| 8500638 | 6/1986 | Germany . |
| 3526793 A1 | 1/1987 | Germany . |
| 2167680 | 6/1986 | United Kingdom . |
| 2246717 | 2/1992 | United Kingdom . |
| 85/02100 | 5/1985 | WIPO . |

*Primary Examiner*—Richard L. Chiesa
*Attorney, Agent, or Firm*—Ian C. McLeod; Mary M. Moyne

[57] ABSTRACT

The invention provides a vacuum cleaner (100) including an airflow path, dirt and dust collecting device arranged in the airflow path, a motor or fan unit (110) for causing air to flow along the airflow path and also arranged therein, a first filter (112) arranged immediately upstream of the motor or fan unit (110) and a second filter (114) arranged downstream of the motor or fan unit (110), wherein the arrangement is such that, when in use the dirt and dust collecting device are made accessible or removed for emptying or replacement, both filters (112, 114) are visible to the user. This arrangement encourages the user of the vacuum cleaner to regularly maintain both filters (112, 114), thus improving the performance of the vacuum cleaner (100).

3 Claims, 1 Drawing Sheet

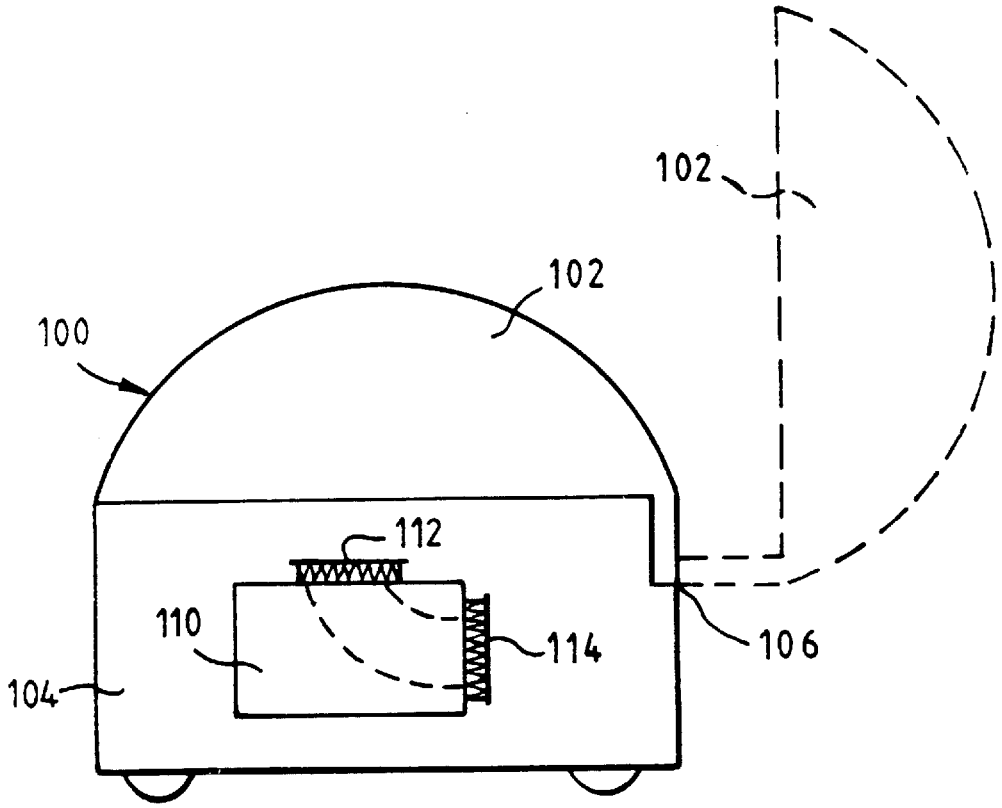
102
102
100
112
110
114
106
104

VACUUM CLEANER AND A FILTER ASSEMBLY THEREFOR

BACKGROUND OF THE INVENTION (1) Summary of the Invention

The invention relates to a vacuum cleaner and to a filter assembly therefor. It will be understood that the term "vacuum cleaner" is here used so as to encompass any type of cleaning apparatus which uses the creation of a vacuum to draw air along an airflow path.

(2) Description of Related Art

Vacuum cleaners of both the upright and cylinder types operate by utilising a motor or fan unit to draw air along an airflow path from a dirty air inlet to a clean air outlet via some sort of filtering or dirt/dust separating apparatus. The air which passes along the airflow path thus passes through the motor or fan unit.

It is known to filter the air passing along the airflow path before it is expelled to the atmosphere. If the appropriate filter is located upstream of the motor or fan unit, any particles of dirt, carbon, etc becoming entrained within the airflow inside the motor or fan unit will inevitably be expelled into the atmosphere with the airflow. If the filter is located downstream of the motor or fan unit, any dirt or dust remaining in the airflow after it has passed through the filtering or dirt/dust separating apparatus will pass through the motor or fan unit. This may cause the motor or fan unit to become unbalanced which will shorten its life and may result in premature failure. Also, dust can collect and build up in the region of the motor or fan unit which can result in sudden unwanted releases of large quantities of fine dust which can cause blockage of the filter or damage the motor or fan unit.

A very few manufacturers have, prior to the date of this application, been fitting electrostatic filters both before and after the motor or fan unit. This has the advantage of preventing dusty air from passing through the motor or fan unit and also of preventing any particles released within the motor or fan unit from escaping into the atmosphere. However, two problems have been identified in respect of this arrangement. Firstly, even if the operator remembers to change one of the filters, the second filter is rarely changed. Presumably this is because changing the first filter gives the operator sufficiently improved performance for the changing of the second filter to be thought unnecessary or else the second filter is forgotten. Secondly, the operator has difficulty in ascertaining that the filters require changing because they are not easily visible.

It is an object of the present invention to provide a filter assembly for use in such a vacuum cleaner.

BRIEF DESCRIPTION OF THE DRAWINGS

The sole FIGURE shows a vacuum cleaner 100 with a cover 102 and casing 104 encasing filters 112 and 114 on motor or fan unit 110.

DESCRIPTION OF PREFERRED EMBODIMENTS

The present invention relates to a vacuum cleaner comprising an airflow path, dirt and dust collecting means arranged in the airflow path, a motor or fan unit for causing air to flow along the airflow path and also arranged therein, a first filter arranged immediately upstream of the motor or fan unit and a second filter arranged downstream of the motor or fan unit, wherein the arrangement is such that, when in use the dirt and dust collecting means are made accessible or removed for emptying or replacement, both filters are visible to the user.

An embodiment of the invention will now be described with reference to the accompanying drawing wherein:

The sole drawing FIGURE shows a vacuum cleaner arranged in accordance with the invention.

The sole drawing FIGURE illustrates the present invention. This drawing shows a vacuum cleaner 100 having a cover 102 which is hinged to a casing 104 about an axis 106 so as to be movable between a closed position (illustrated in solid lines) and an open position (illustrated in broken lines). Inside the casing 104 are located dirt or dust collecting means (not shown) and a motor or fan unit 110. First and second filters 112,114 are located immediately upstream and downstream respectively of the motor or fan unit 110. The filters 112,114 are preferably electrostatic filters but alternative types of filter are equally suitable. Furthermore, the filters 112,114 can be connected together to form a single filter assembly if desired.

The motor or fan unit 110 is located inside the casing 104 such that, when the cover 102 is moved from the closed position to the open position, the filters 112,114 become visible to the user of the machine. This allows the user to see quickly and easily whether either of the filters 112,114 requires to be replaced or cleaned. This in turn encourages the user to replace each filter 112,114 as and when required which improves the performance of the vacuum cleaner 100.

The movement of the cover 102 from the closed position to the open position is necessary in order to provide access to the dirt and dust collecting means for emptying or replacement purposes. Thus, if a bag or bin is located inside the casing 104, the user is encouraged to look at the filters 112,114 each time the bag or bin is emptied of dirt or dust collected by the vacuum cleaner 100. The vacuum cleaner 100 shown in FIG. 1 is a cylinder-type vacuum cleaner which preferably incorporates cyclonic dirt or dust collecting means (not shown) located inside the casing 104. However, it is possible to apply the present invention to upright-type vacuum cleaners. The filters, which are unsightly, can be concealed from view when the vacuum cleaner is in normal use by a cover or panel, or else by the dirt or dust separating means themselves. When the cover or panel is removed, or the dirt or dust collecting means is removed for emptying or replacement, both filters are rendered visible to the user.

It will be appreciated by a reader skilled in the art that the invention is not restricted to the specific embodiment described above.

I claim:

1. In a vacuum cleaner comprising an airflow path, dirt and dust collecting means arranged in the airflow path, a motor or fan unit for causing air to flow along the airflow path the improvement which comprises;

a movable cover covering a casing containing the dirt and dust collecting means which is cyclonic and containing the motor or fan unit with a first filter arranged upstream of the motor or fan unit and a second filter arranged downstream of the motor or fan unit during use, wherein air flows from the collecting means into the motor or fan unit through the first filter and away from the motor or fan unit through the second filter, wherein when the cover is opened, both filters are visible to the user and wherein the filters can be replaced when the filters have collected dust and dirt.

2. The vacuum cleaner of claim 1 wherein the filters are electrostatic filters.

3. The vacuum cleaner of claim 1 wherein the cover is attached to the casing by a hinge.

* * * * *